US006011223A

United States Patent [19]

Poller et al.

[11] Patent Number: 6,011,223

[45] Date of Patent: Jan. 4, 2000

[54] CONTAINER COMPRISING A FLEXIBLE INTERNAL PART

[75] Inventors: Stephan Poller, Ludwigsburg; Viktor Weigel, Asperg, both of Germany

[73] Assignee: Mann & Hummel ProTec GmbH, Ludwigsburg, Germany

[21] Appl. No.: 09/056,640

[22] Filed: Apr. 8, 1998

[30] Foreign Application Priority Data

Apr. 8, 1997 [DE] Germany ..... 297 06 183 U

[51] Int. Cl.[7] ..... G01G 13/18; B67D 5/08

[52] U.S. Cl. ..... 177/105; 177/116; 222/58; 222/77

[58] Field of Search ..... 222/102, 203, 222/58, 77, 481, 504, 529; 251/4, 9; 177/105, 116, 122, 123, 160, 263; 141/248, 279

[56] References Cited

U.S. PATENT DOCUMENTS

| | | | |
|---|---|---|---|
| 3,308,898 | 3/1967 | Adlen et al. | 177/116 |
| 3,411,534 | 11/1968 | Rose | 251/9 |
| 3,450,152 | 6/1969 | Ouellette | 251/9 |
| 3,467,151 | 9/1969 | Vogt | 251/9 |
| 4,944,428 | 7/1990 | Gmür et al. | 222/55 |
| 5,127,483 | 7/1992 | Hough | 177/105 |
| 5,670,751 | 9/1997 | Hätner | 177/116 |
| 5,697,523 | 12/1997 | Brandauer | 222/58 |
| 5,753,868 | 5/1998 | Diem | 177/116 |

*Primary Examiner*—Randy W. Gibson
*Attorney, Agent, or Firm*—Evenson, McKeown, Edwards & Lenahan, P.L.L.C.

[57] ABSTRACT

The invention relates to a container with a flexible internal part (6), particularly suitable for weighing bulk material, comprising a closure mechanism within the exit area of the internal part (6) as well as at least two partial exits (18, 19) to be charged, located at the internal part (6) for further processing said bulk material. By means of said locking mechanism, it is practicable to press at least one partial area of the flexible internal part (6) laterally from outside against a sword (14) which is located inside within the exit area of the internal part. This way, said sword (14) separates the partial exits (18, 19) from each other, whereby in each case, one of the partial exits (18, 19) is closable.

8 Claims, 2 Drawing Sheets

CONTAINER COMPRISING A FLEXIBLE INTERNAL PART

STATE OF ART

Figure 1:
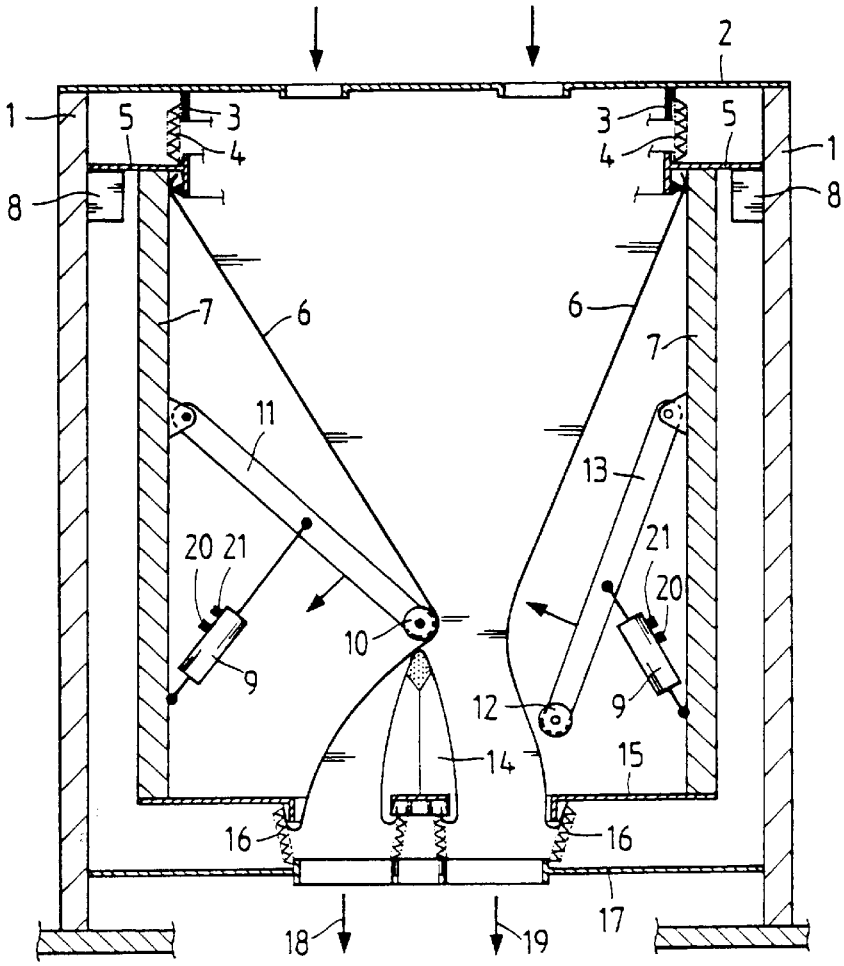

The invention relates to a container having a flexible internal part, in particular for weighing bulk material, according to the preamble to the principal claim.

The European Patent Specification EP 0 714 016 A2 discloses, for example, a container with a flexible internal part, in which the internal part—being a flexible weighing container for balancing bulk material or metering material—is supported on an outer frame by way of at least one weighing cell. In this instance, the metering material is being weighed in batch quantities within said weighing container, whereby a squeezing device shuts off the flexible internal part when weighing the batches. It is then possible to distribute the batches to two different exits by way of a displacement mechanism which is located at the exit of the internal chamber. There are already many instances known in which containers have been used that comprise a flexible internal part manufactured from durable plastic material land/or caoutchouc rubber, in order to keep and to balance poor-flow bulk materials, for instance powdered bulk materials, as for example, PVC. In the field of materials processing, poor-flowing bulk materials of such a kind are being weighed very often in order to be able to produce exact mixtures for the further processing. The bulk material is being proportioned by means of appropriate metering devices. Achieving a high quality of the product also requires a complete discharge of the container, apart from exactly weighing and proportioning the bulk materials, Seeing it on the whole, it is additionally known that—within the field of materials processing—bulk materials are further processed by using batch-processed mixers. In order to use containers or container scales, topped by said mixers, to economical capacity, the same are connected to more than one mixer. This way, it is, for example, practicable that containers and container balances provide two different mixers with poor-flowing bulk materials in an alternate manner. For this purpose, it is, however, necessary to variably connect the containers or container balances respectively to the succeeding mixers. Usually, flexible pipes are therefore in use, in order to prevent bulk material from clinging to the material wall. According to the state of technology, the bulk material is distributed to two mixers by means of so-called rotary dampers or rotary switches. The disadvantage of said already known rotary dampers or rotary switches is that they are of a large construction height and that the bulk material clings to the material of said dampers or switches very easily, thus leading to a clogging.

In addition, the material left clinging to the wall has an unfavorable influence on the mixture, because it is not possible for all of the material being balanced to reach the mixer. This step takes place at a later time. Disadvantageously, the material then reaches the other branch, which means, the second mixer where, in that case, the mixture of the latter is being falsified.

Apart from that, one drawback of this rotary switch added on the flexible weighing chamber is that adding the same requires a great deal of mechanical expenditure. In addition, problems are encountered with sealing the switch against the ambience. The danger prevails that it is possible for dust to escape from the switch, thus leading to a contamination of the ambience. Another disadvantage is that wear-intensive products—as they are in frequent use—undergo a high degree of abrasion in the case of switches comprising a displacement mechanism.

DEFINITION OF THE OBJECT

The object underlying the invention is to advance a container of that kind as described previously in such a way that it is guaranteed to distribute metering material easily and, at the same time, ensuring a high quality of processing as well as a low expenditure concerning the constructive design.

ADVANTAGES OF THE INVENTION

The container according to the invention, which has a flexible internal part, meets the object underlying this invention by the distinguishing features of the principal claim, whereby it is particularly practicable to charge bulk material to two consumer units very easily and whereby it shall be especially noted that dustfree conditions are given as well as a constructive design which is favourable with regard to abrasion.

In the case of the closure mechanism according to the invention, at least one partial area of the flexible internal part is advantageously pressed laterally from outside against a sword which is located inside within the exit area of said internal part. In this instance, said sword separates at least two partial exits from each other, so that it is possible to close each of the partial exits.

In accordance with a preferred exemplified embodiment, the internal part is supported on a frame. The bottom end of the flexible internal part ends in a Y-branch which can be divided into two partial exits by means of the sword. In this instance, it is of advantage that the respective partial exits and/or the internal part in its entirety can be blocked by way of two movable locking levers of the closing mechanism that are independent from one another. In order to weigh particular charges of bulk material, it is then possible to easily hold the flexible internal part on the frame by means of at least one weighing cell.

According to an advantageous embodiment, each end of the locking levers is provided with a locking roll for pressing against the areas of the flexible internal part, whereby said locking rolls move on a circular path around the fulcrum of the respective locking lever, and tightly seal the corresponding partial exit when being swivelled in the position facing the sword.

In a preferred embodiment, the circular paths of the locking rolls are determined in such a way that one of the locking rolls rests more or less on the point of the sword and the other locking roll approximately rests on the flank of the sword. By way of this development, it is practicable that both locking rolls—in either locking position—compress the respective areas of the flexible internal part above the sword, thus closing the flexible internal part in its entirety.

Both locking levers are movable, for example, by means of simply-structured pneumatic cylinders, whereby it is of advantage that said pneumatic cylinders can be checked in both finals positions by providing proximity sensors or limit switches. In this instance, one of the proximity sensors recognizes the position of the locking roll located on the point of the sword, while the second proximity sensor recognizes that position of the locking roll on the flank of the sword. The closeness of this lock for both the two partial exits together and for each individual partial exit is ensured by way of this special motional mechanics of the lock.

In a preferred manner, the flexible internal part is developed in such a way that the upper section of the same runs conically towards the bottom section, and that the conus broadens again shortly above the locking mechanism, so that it is practicable to squeeze the flexible internal part at that squeezing point without virtually causing any dead space.

According to this invention, the advantages of a flexible container, that is also weighable, fully remain preserved up to both partial exits. The reason for it is that the whole internal part can be manufactured in one piece and that it consists of elastic plastic material and/or caoutchouc material, meaning that—owing to said elastic material—, there is no longer any risk prevailing that bulk material remains clinging to the walls, neither interior of the internal part nor to the sword upon blocking operations. Following each of both partial exits, it is possible to establish the connection line—for example, by way of a flexible tube—, towards the succeeding mixers provided for bulk material upon balancing. Another advantage is that the branch towards both following mixers as well as the locking unit are configured to be one joint device. By way of this arrangement, it is likewise possible to reduce the construction height of container scales considerably.

DRAWINGS

Figure 2:
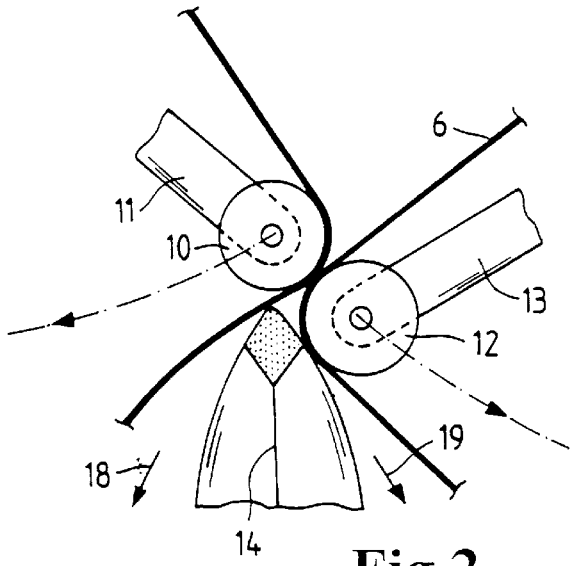
Figure 3:
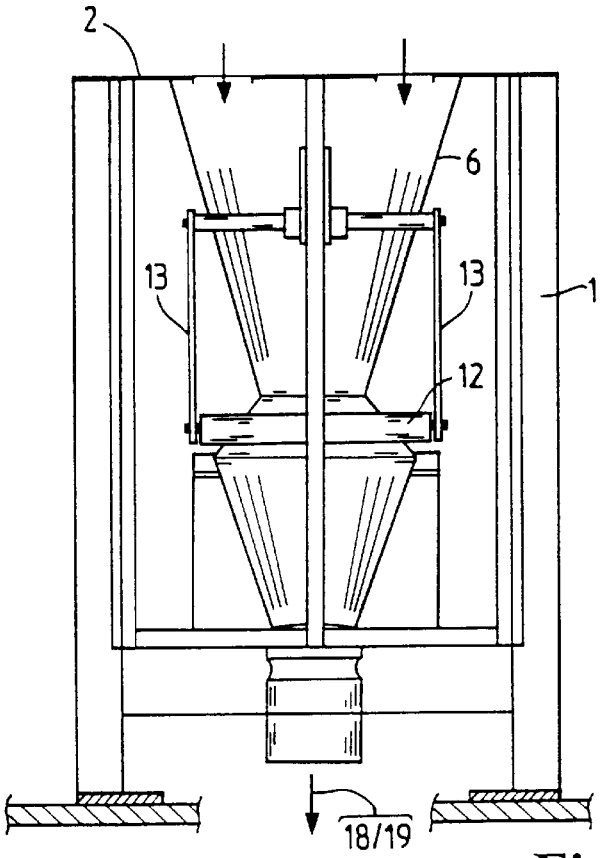
Figure 4:
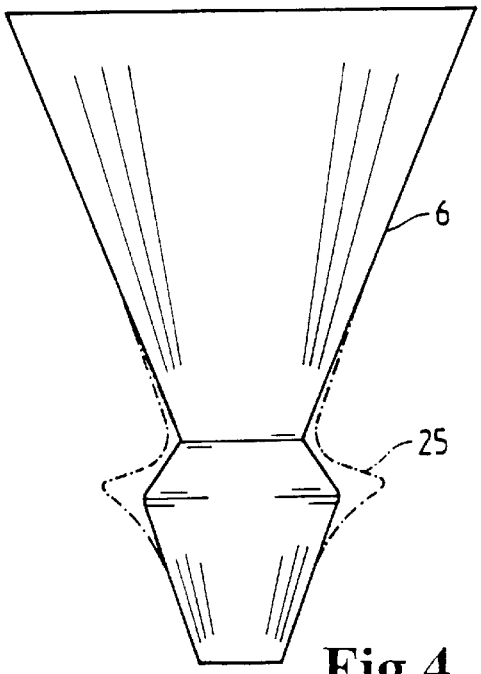

One exemplified embodiment of the container according to the invention is illustrated in the drawings and is described hereinafter in more detail. In the drawings:

FIG. 1 is a schematic sectional illustration of the container with a flexible internal part as well as two partial exits, FIG. 2 is a detail illustration of the locking mechanism, FIG. 3 shows another view of the container comprising a flexible internal part, and FIG. 4 shows the profile of the flexible internal part.

DESCRIPTION OF THE EXEMPLIFIED EMBODIMENT

FIG. 1 represents a container suitable for weighing bulk material which comprises an outer frame 1 with an upper mounting plate 2. A flexible collar 4 is affixed to the mounting plate 3 via a top connection piece 3, with a top inner connection piece 5 being fastened to said flexible collar. A flexible internal part 6 is fastened to the top inner connecting piece 5 by means of hose clamps. This embodiment ensures that bulk material is charged from above and that it is possible for the same to reach the flexible internal part 6 in small quantities without giving off any dust to the surrounding area.

An inner frame 7 retains the top inner connecting piece 5. Simultaneously, it is practicable that weighing cells 8 balance said inner frame 7, which carries the flexible internal part 6 through the top inner connecting piece 5. In this embodiment, the weighing cells 8 are attached to the outer frame 1. According to the present illustrated exemplified embodiment, by providing the flexible collar 4 there is no force transmission to the internal part 6 or the frame 7 of the same respectively, so that said internal part 6 can be weighed by way of these weighing cells 8. The flexible internal part 6 can be divided downward into two partial openings 18 and 19. For that reason, the bottom end of the internal part is configured as a Y-tube which ends in two partial exits 18 and 19. Both partial exits 18 and 19, in turn, are connected to a bottom mounting base 17 by means of a flexible collar 16. In this instance, too, it is guaranteed that dustfree conditions are given while transporting the bulk material.

Attaching both partial exits 18 and 19 of the flexible internal part 6 to the bottom mounting base 17 can be realized by turning said flexible internal part 6 over an additional connecting piece. As a result of this flexible collar 16, it is likewise guaranteed that dustfree conditions are given as well as sufficient freedom of motion for exerting the weighing operations.

Blocking the internal part 6 and optionally opening one of both exits 18 or 19 can be realized by way of two locking levers 11 and 13, with one locking roll 10 or 12 respectively being placed on each of the locking lever points. At one of their ends, said locking levers 11 and 13 are hinge-mounted to the inner frame 7.

By means of two pneumatic cylinders 9—one pneumatic cylinder end being attached to the inner frame 7—, both locking levers 11 and 13 are moved in circles around their fulcrum in such a way that the flexible internal part 6 will be blocked above a sword 14. This embodiment is feasible from either side. With regard to the checking, both cylinders 9 are provided with limit switches or proximity sensors 20 and 21 respectively. As can be seen in FIG. 1, the flexible internal part 6 is positioned in such a way that the exit 19 on the right side is opened. At the same time, the locking lever 11 in conjunction with the locking roll 10 blocks exit 18 on the left side. By way of positioning the locking roll 10 above the sword 14, it is guaranteed that no bulk material will fall in exit 18 on the left side.

The presentation according to FIG. 2 is a detailed illustration of the locking mechanism in its entirety arranged in the exit area of the internal part 6. In this present illustration, both locking rolls 10 and 12 are shown in the closed state, in which the whole flexible internal part 6 is closed, for example, during the weighing operations. In this case, the locking roll 10 on the left side is located above the middle area or the point of the sword 14, then closing the exit 18 on the left side.

In accordance with FIG. 2, by providing that both sides of the flexible internal part 6—lying one on another—are located between the sword 14 and the locking roll 10, it is ensured that exit 18 gets closed in a sealing manner. This closure is even intensified by providing a projection, of half size of the locking roll 10 diameter, into the exit 19.

It is necessary that locking roll 12 rests on the flank of the sword 14 and on the locking roll 10, in order to enable a sealing of exit 19. Because of the fact that both sides of the flexible internal part 6 lie between the two locking rolls 10 and 12 as well as between the flank of sword 14 and the locking roll 12, the partial exit 19 on the right side is thus sealed either.

Moving the locking rolls 10 and 12 in circular paths about the fulcrum of locking levers 11 and 13 ensures that the closing mechanism—as described previously—is practicable for both the partial exit on the left side as well as the partial exit on the right side. To monitor the limit positions on the sword 14 point and on the sword 14 flank, it is necessary, in this instance, to utilize two different limit switches 20 and 21.

FIG. 3 is a side view of the container comprising the flexible internal part 6, in which the corresponding components are provided with the same reference numbers.

FIG. 4 shows a side view of the flexible internal part 6, whereby said flexible internal part 6 is designed in such a way that the top section runs conically towards the bottom. Shortly above the closure—indicated within the present illustration by the dash-and-dot line 25—, the conus broadens and then, being inside the Y-tube, it tapers again to the size of the exit diameter. A more or less cylindrically-shaped member forms the closure end at both partial exits 18 and 19 of the internal part.

By way of the arrangement according to FIG. 4, it is guaranteed that—in the closed position in which both locking rolls 10 and 12 take up their final positions as illustrated in FIG. 2—there is no crimping in the squeezed cross-section and that there is no dead space in the upper section of the flexible internal part 6, into which any bulk material may deposit. This effect can be achieved by providing a broadening conus. In that case, bulk material which remains above the crushing point 25, falls through the configured conus when opening one side of the respective partial exit 18 or 19.

We claim:

1. A container having a flexible internal part with a discharge area, a sword member arranged in said discharge area so as to subdivide said discharge area into at least two outlet portions, and a closure mechanism arranged in said discharge area outside said flexible internal part, said closure mechanism comprising independently movable locking levers, each of said locking levers having a locking roll arranged at an end thereof being operable to press respective portions of said flexible internal part laterally against said sword member to selectively close one or the other of said outlet portions, each locking roll moving on a circular path around a fulcrum of the locking lever on which it is mounted to sealingly close the respective outlet portion when the respective locking lever is pivoted against said sword member.

2. A container according to claim 1, further comprising a support frame supporting said flexible internal part, said flexible internal part having a lower section which is divided by said sword member and the locking mechanism into said two outlet portions, whereby a Y-joint is formed, said closure mechanism comprising two independently movable locking levers each of which closes a respective one of said two outlet portions, and wherein said locking levers are individually movable to selectively block one or the other of said two outlet portions or the entire discharge area.

3. A container according to claim 2, wherein said flexible internal part is supported on said support frame through at least one weighing cell.

4. A container according to claim 1, wherein said locking rolls move along circular paths such that one locking roll rests adjacent a point of said sword member and the other locking roll rests against a flank of said sword member.

5. A container according to claim 1, wherein both locking rolls are movable into positions in which they simultaneously press the respective portions of said flexible internal part against said sword, whereby said discharge area is completely closed.

6. A container according to claim 1, wherein said locking levers are moved by respective pneumatic cylinders connected thereto; said container further comprising a first and second proximity sensors for respectively detecting when each of said locking rolls is moved against said sword member.

7. A container according to claim 6, wherein said proximity sensors are limit switches.

8. A container according to claim 1, wherein said flexible internal part comprises an upper portion which extends conically downwardly, an intermediate portion which broadens out again shortly above the closure mechanism, and a lower portion which tapers conically again to a size equal to the diameter of the outlet, whereby virtually no dead space is created when said flexible internal part is pressed against said sword member to close at least one of said outlet portions.

* * * * *